United States Patent [19]

Masaki et al.

[11] 4,150,644

[45] Apr. 24, 1979

[54] METHOD FOR CONTROLLING ELECTROSTATIC FUEL INJECTORS

[75] Inventors: Kenji Masaki; Hiroyuki Maruoka, both of Yokohama, Japan

[73] Assignee: Nissan Motor Company, Limited, Japan

[21] Appl. No.: 801,395

[22] Filed: May 27, 1977

[30] Foreign Application Priority Data

May 29, 1976 [JP] Japan ..... 51-61783
May 29, 1976 [JP] Japan ..... 51-61784

[51] Int. Cl.[2] ..... F02M 51/02; B05B 5/02
[52] U.S. Cl. ..... 123/119 E; 239/696
[58] Field of Search ..... 123/119 E; 239/3, 15; 361/225, 228

[56] References Cited

U.S. PATENT DOCUMENTS 3,941,312 3/1976 Ohno et al. ..... 239/102 X

FOREIGN PATENT DOCUMENTS 1027113 3/1958 Fed. Rep. of Germany ..... 351/225
1421049 1/1970 Fed. Rep. of Germany ..... 239/15
2449848 5/1976 Fed. Rep. of Germany ..... 123/119 X
2521141 11/1976 Fed. Rep. of Germany ..... 123/119 E

*Primary Examiner*—Carlton R. Croyle
*Assistant Examiner*—Michael Koczo, Jr.
*Attorney, Agent, or Firm*—Robert E. Burns; Emmanuel J. Lobato; Bruce L. Adams

[57] ABSTRACT

An electrostatic fuel injector includes a plurality of threadlike tubes for ejecting charged fuel, an accelerator electrode for accelerating the fuel and a control electrode for modulating the amount of fuel ejected. A method for controlling the fuel injector includes applying a control bias to the control electrode with respect to the accelerator electrode in response to an engine operating parameter so as to modulate the amount of fuel in proportion to engine load. A plurality of such fuel injectors is stepwisely operated in response to the engine operating parameter to provide a wide range of variations in fuel quantity.

4 Claims, 7 Drawing Figures

14-4
14-3
14-1
14-2
94
76
92
91
93
80
90A
90B
78
A
86
a
90C
b1
B
b2
90D
95
C1
C
C2
d
D
ELECTRO-MECHANICAL TRANSDUCER
82
84
FROM ENGINE PARAMETER SENSORS
36
CONTROL CIRCUIT
FROM ENGINE PARAMETER SENSORS

METHOD FOR CONTROLLING ELECTROSTATIC FUEL INJECTORS

FIELD OF THE INVENTION

The present invention relates to fuel injection, and in particular to a method for controlling an electrostatic fuel injection unit for use in combustion systems.

BACKGROUND OF THE INVENTION

Conventional air-fuel delivery systems can be broadly divided into two types: Carburetion and fuel injection. The carburetion system only permits the use of light fuel oil and is becoming increasingly complex in mechanism because of the need to meet the recent emission control requirements with the consequential increase in cost. Fuel injection for Diesel engines employs a fuel pump for compressing air and, at the point of maximum compression, fuel oil is injected into the combustion chamber and ignition takes place as a result of the high temperature which has been created. In electronic fuel injection, the fuel injectors are essentially solenoid actuated on/off poppet valves incorporating pintles designed for metering and atomization of light fuel oil, which requires precision in machining and becomes costly in mass production.

Fuel injection operating on the principle of electrostatic attraction and repulsion as described in copending U.S. patent application Ser. No. 778,944 filed on Mar. 10, 1977 and assigned to the same assignee of the present invention, is advantageous over the prior art fuel injection in that the disclosed fuel injection permits the use of both light and heavy fuel oils, is simple in construction and easy to regulate the amount of fuel to be injected.

SUMMARY OF THE INVENTION

An object of the present invention is to provide a method for controlling an electrostatic fuel injection unit of the afore-said copending U.S. patent application.

Another object of the invention is to provide a method for controlling an electrostatic fuel injector having an accelerator electrode for accelerating ejected fuel and a control electrode in which the control electrode is biased with respect to the accelerator electrode to modulate the amount of ejected fuel in response to a detected engine operating parameter such as accelerator pedal depression.

A further object of the present invention is to provide a method for controlling a plurality of electrostatic fuel injection units in succession to achieve a wide range of variations of fuel quantity to be injected.

BRIEF DESCRIPTION OF THE DRAWINGS

The invention will be further described with reference to the accompanying drawings, in which.

DESCRIPTION OF THE PREFERRED EMBODIMENTS

Figure 1:
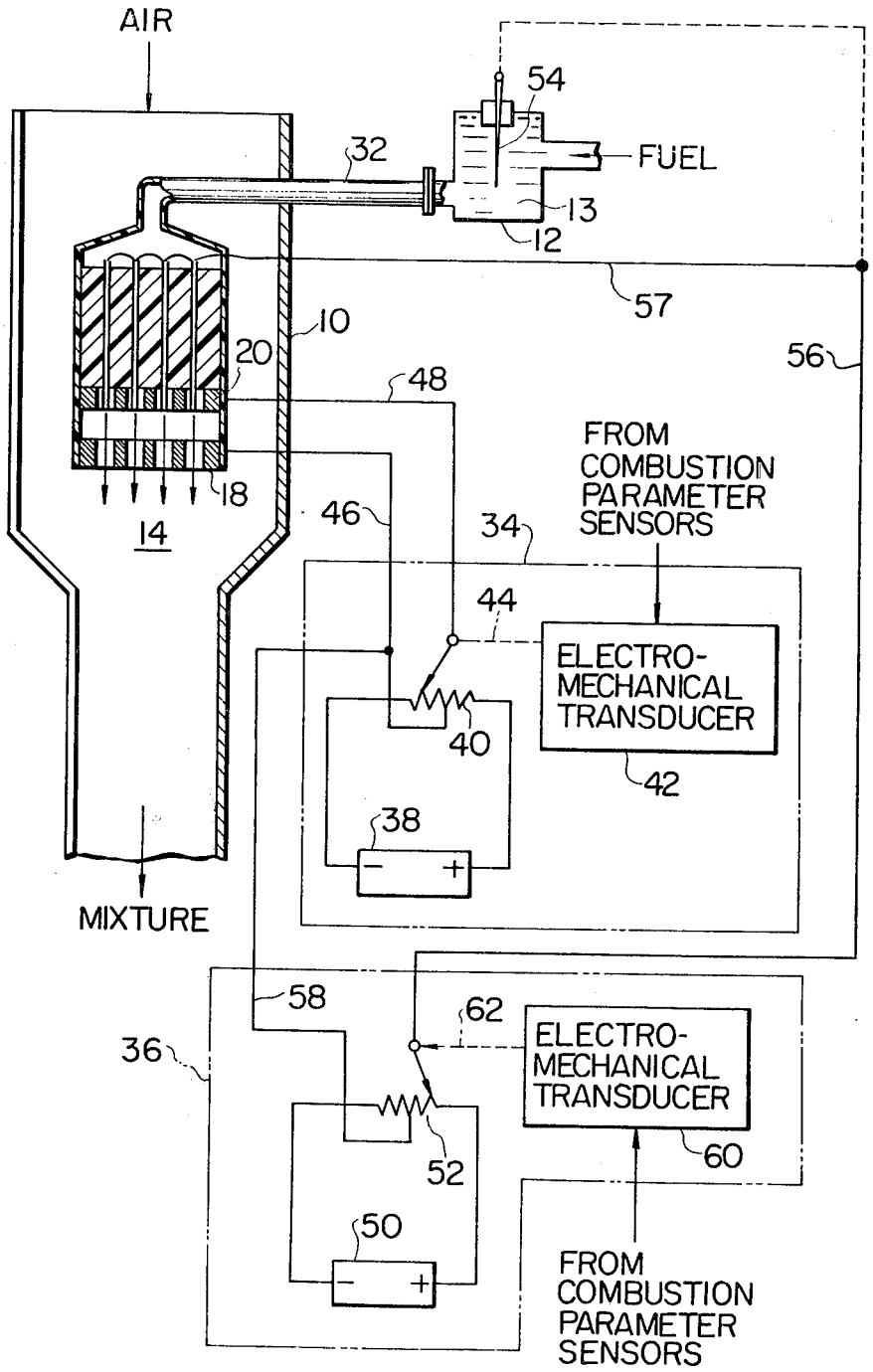
FIG. 1 is a schematic diagram of an embodiment of the invention.

Referring now to FIG. 1, a fuel combustion system embodying the present invention is illustrated as comprising an air intake pipe 10, a fuel supply container 12 for holding fuel 13 and a fuel injection unit 14 disposed in the intake pipe 10 in communication with the fuel supply container 12 through conduit 32.

Figure 3:
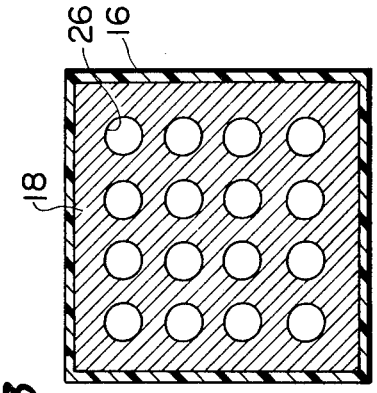
FIG. 3 is a cross-sectional view taken along the lines 3—3 of FIG. 2.
Figure 4:
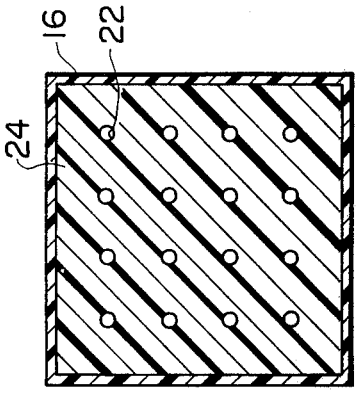
FIG. 4 is a cross-sectional view taken along the lines 4—4 of FIG. 2.
Figure 2:
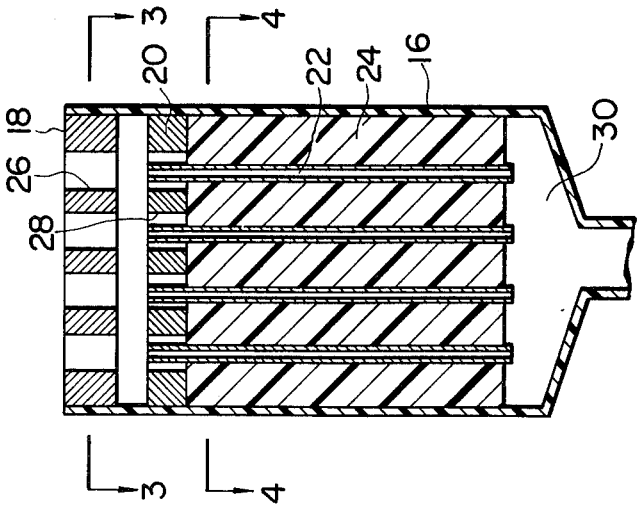
FIG. 2 is a cross-sectional view of an electrostatic fuel injector used in the embodiment of FIG. 1.

As clearly illustrated in FIGS. 2 to 4, the fuel injection unit or injector 14 comprises a housing 16, an apertured accelerator electrode 18 disposed at the forward end of the housing, an apertured control electrode 20 spaced downwardly from the accelerator electrode 18 and a plurality of parallel fuel delivery nozzles 22 embedded into an insulating body 24. The apertures 26 of accelerator electrode 18 are coaxially aligned with apertures 28 of control electrode 20. Each nozzle 22 is formed by a conductive threadlike tubular member and extends upwardly into the bore 28 and is coaxially aligned therewith. The upstream end of each nozzle is in communication with the fuel supply container 12 through a chamber 30 connected to the conduit 32.

The combustion system includes a first voltage control circuit 34 and a second voltage control circuit 36. The first voltage control circuit 34 comprises a voltage source 38 with a DC potential of the order of several hundreds volts, a variable resistor 40 with its opposite ends connected across the terminals of the voltage source 38, and an electromechanical transducer 42 of the type which translates an input signal applied thereto into a corresponding mechanical movement. The wiper terminal of the variable resistor 40 is operatively connected by a linkage indicated by broken lines 44 to the transducer 42. A point intermediate the ends of the variable resistor 40 is connected to the accelerator electrode 18 of the injector 14 through lead 46 and the wiper terminal of the resistor 40 is connected to the control electrode 20 through lead 48.

Similarly, the second voltage control circuit 36 comprises a voltage source 50 with a DC potential of the order of from several kilovolts to several tens of kilovolts, and a variable resistor 52 with its opposite ends connected across the terminals of the voltage source 50 and its wiper terminal connected through leads 56 and 57 to the tube 22 which are connected together. A charging electrode 54 is immersed in the fuel container 12 and connected if necessary to the wiper terminal 62 of resistor 52. The intermediate point of the resistor 52 is connected through lead 58 to the accelerator electrode 18 of the injector 14. An electromechanical transducer 60 is provided to translate an input signal applied thereto into a corresponding mechanical movement with which the wiper terminal of resistor 52 is made to move along the length of the resistor 52 through a mechanical linkage indicated by broken lines 62.

When the wiper terminal of each variable resistor is positioned at the intermediate point of the corresponding resistor, there is no potential developed across the accelerator and control electrodes 18 and 20 as well as across the accelerator electrode 18 and the charging electrode 54. With the wiper terminal of resistor 40 being positioned at the intermediate point, a shift of wiper terminal of resistor 52 to the right of its intermediate point will generate a bias potential across the charging electrode 54 and the accelerator electrode 18, so that fuel 13 is positively charged with respect to the accelerator electrode 18. The charged fuel is led through the conduit 32 and tubular members 22 of the injector 14 for subsequent ejection into the intake passage 10. At the delivery end of the threadlike tubes 22 the charged fuel tends to atomize by electrostatic repulsion between the charged particles and is attracted by the negative potential at the accelerator electrode 18 and accelerated at such high speeds as to pass through the apertures of the electrode 18. The ejected atomized fuel is then mixed with the inducted air and passed into a combustion chamber (not shown). Fuel will be negatively charged when the wiper terminal of resistor 52 is moved to the left of its intermediate point and the charged fuel is ejected in the same manner as when positively charged.

The amount of fuel ejected can be varied by controlling the accelerating potential between the accelerator electrode 18 and the charging electrode 54 in response to a signal derived from a detected operating parameter of the combustion system representing the throttle position.

The electromechanical transducer 60 receives the signals representing such operating parameters from sensors (not shown) and converts the signals into a corresponding mechanical movement which is transmitted by a mechanical linkage 62 to the wiper terminal of resistor 52.

Fuel control is also achieved by varying the potential across the accelerator and control electrodes 18 and 20. Assume that the accelerator electrode 18 is biased at a given negative potential with respect to the charging electrode 54, the application of negative potential of the order of several hundred volts to the control electrode will assist in ejecting the fuel particles. Conversely, the application of a reverse bias potential to the control electrode will retard the fuel particles and the amount of ejected fuel decreases in proportion to the reverse control bias until a cut-off level is reached.

The control potential at the control electrode 20 with respect to the accelerator electrode 18 may be modulated with detected engine operating parameters such as engine temperature, engine RPM and intake vacuum pressure. The sensed parameters are fed into the electromechanical transducer 42, where the signals are converted into a corresponding movement of the wiper terminal of resistor 40. When the wiper terminal is positioned to the right of the intermediate point, the control electrode 20 will be biased positive with respect to the accelerator electrode and biased negative when the wiper terminal is positioned to the left of the intermediate point.

It will be understood that at a given accelerating potential the delivered fuel quantity increases when the control electrode is biased opposite to the accelerator electrode and decreases when the polarity is reversed.

It will be appreciated that the accelerating and controlling potentials may be simultaneously controlled to provide more accurate fuel delivery control than is possible with the modulation of one of the potentials.

Figure 5:
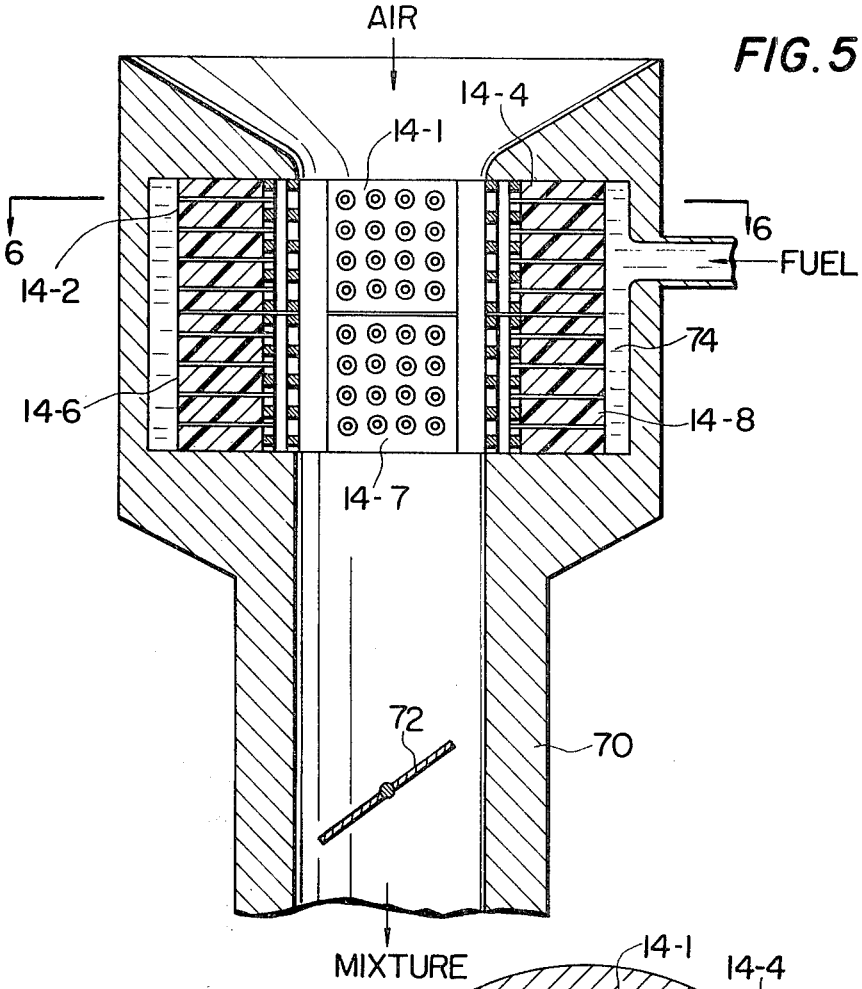
FIG. 5 is a cross-sectional view of an air intake pipe of an internal combustion engine with a plurality of fuel injection units mounted therein.
Figure 6:
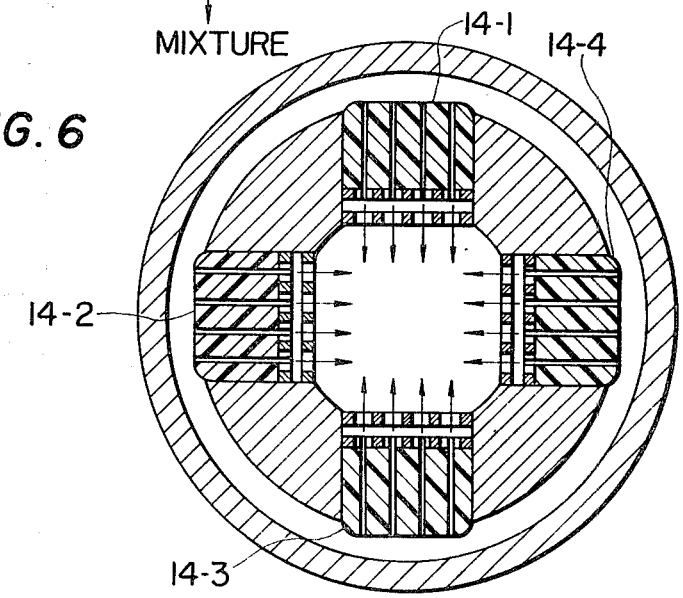
FIG. 6 is a cross-sectional view taken along the lines 6—6 of FIG. 5.
Figure 7:
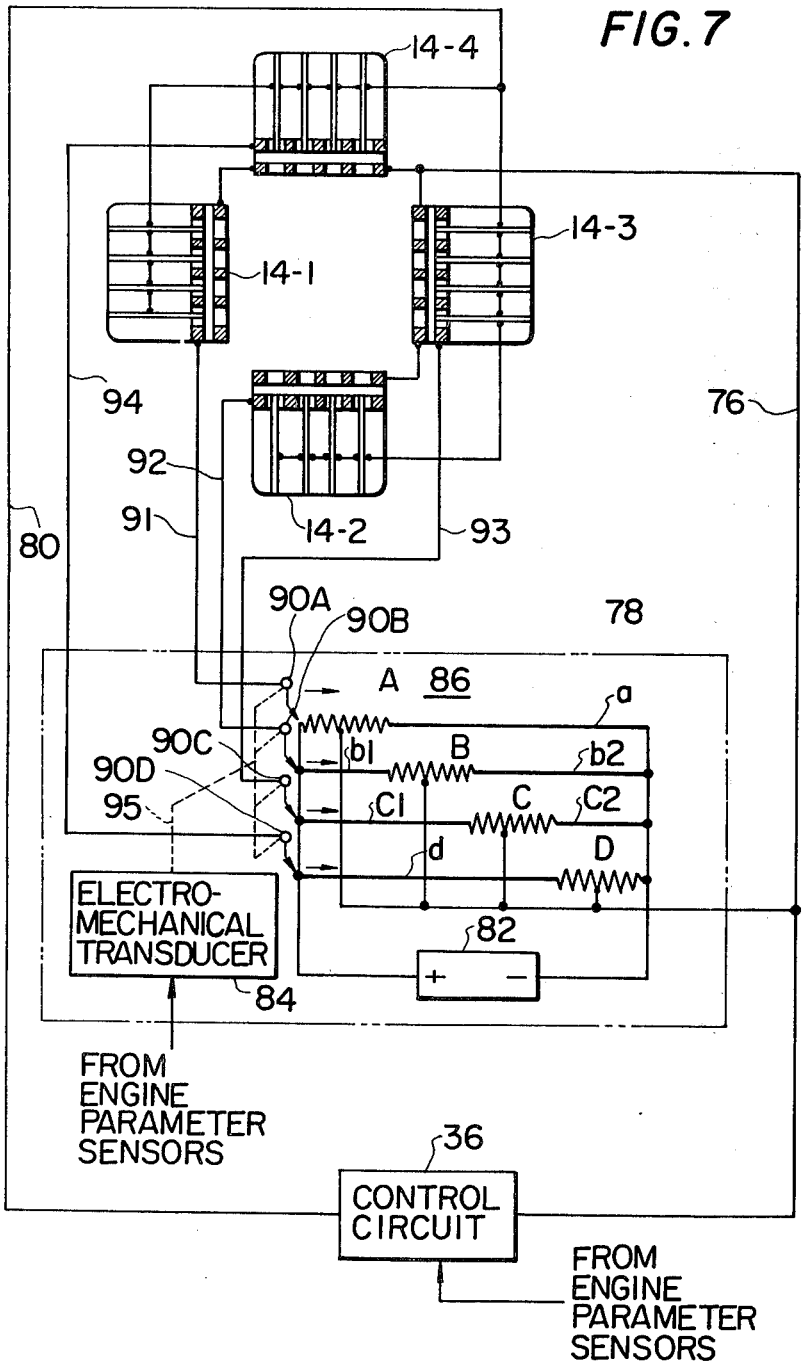
FIG. 7 is a circuit block diagram for operating the injection units of FIG. 5.

In FIGS. 5 to 7, the fuel injector 14 is shown as employed in a vehicle internal combustion engine. In FIG. 5, an air intake pipe 70 is formed to accommodate a plurality of injector units 14 of the type as described above. The injectors 14 are stacked one upon another and arranged radially as best seen in FIG. 6. Air is inducted through a flared end of the pipe 70 to pass through the fuel delivery ends of the injectors toward the throttle valve 72 mounted downstream of the injectors 14. Fuel is supplied from a source (not shown) into a chamber 74 formed between the rear end of the injectors and the adjacent wall of the pipe 70.

As illustrated in FIG. 7, the accelerator electrodes of the injector units 14-1 to 14-4 (injectors 14-5 to 14-8 are omitted for the sake of simplicity) are connected together to one terminal of the voltage control circuit 36 as previously described and to a control circuit 78 through lead 76. Similarly, the tubular members of the injectors are connected together to the other terminal of the voltage control circuit 36 through lead 80.

The voltage control circuit 78 includes a voltage source 82 of several hundreds volts and an electromechanical transducer 84 of the type as previously described. A variable resistor 86 is provided which includes four resistance circuit branches having four resistance elements A, B, C and D of equal resistance value and length. The resistance A is positioned at the leftmost position and connected to a strip of conductor element a having three times the length of the resistance A. The resistance B is displaced from the leftmost position by the length of each resistance or unit length and connected at one end to a conductive strip b1 and at the other end to a conductive strip b2. The conductive strip b1 has the unit length and the strip b2 twice that length. The resistance C is displaced by twice the unit length from the leftmost position and connected at one end to a conductive strip c1 having twice the unit length and at the other end to a conductive strip c2 of the unit length. The resistance D is positioned at the rightmost position and connected at one end to a strip of conductor d having three times the unit length. The leftmost ends of the resistance circuits are connected together to the positive terminal of the voltage source 82 and the rightmost ends are connected together to the negative terminal of the voltage source 82. These resistances have their intermediate points connected together to the accelerator electrodes of the injectors.

Wiper terminals 90A, 90B, 90C and 90D are provided for the resistance circuit branches and ganged together for joint movement along the length of the corresponding resistance circuits. The wiper terminals 90A to 90D are connected to the control electrodes of the injectors 14-1, 14-2, 14-3 and 14-4 through leads 91, 92, 93 and 94, respectively, and in turn operatively connected through a linkage 95 to the electromechanical transducer 84.

Engine operating parameters such as coolant temperature and intake vacuum are sensed by detectors (not shown) and supplied to the transducer 84, which in turn causes the wiper terminals 90A to 90D to be moved simultaneously by an amount proportional to the applied input signal in the direction as indicated by the arrows in FIG. 7.

Assume that the accelerator electrodes of all the injectors are biased at a given negative potential relative to the corresponding fuel charging tubular electrodes, and that all the wiper terminals are positioned at the leftmost position, the control electrodes are all equally biased at a positive potential with respect to the corresponding accelerator electrodes such that each injector is biased to the cut-off level. As a result, no fuel is ejected from the injectors. As the wiper terminals are shifted to the right slightly so that only wiper 90A is in contact with the resistance A, the control bias applied to injector 14-1 rises above the cut-off level and fuel starts at zero and increases with the rightward movement of the wiper 90A until it comes to the conductive strip a. When the wiper terminal 90B reaches the resistance B, the control bias applied to injector 14-2 will cause fuel to start at zero, the amount of which increases with the wiper movement until the conductive strip b2 is reached.

Therefore, while the wiper 90B is in contact with the resistance B, the injector 14-1 is operated at its maximum capacity and the injector 14-2 is operated in a range from minimum to maximum capacities, and the other injectors remain cut off. In like manner, a further movement of wipers to the right will cause the injector 14-3 and then injector 14-4 to successively start operating in a range from minimum to maximum capacities until the wipers reach the rightmost position.

It is understood that the fuel injectors 14-1 to 14-4 are successively brought into operation and the overall fuel quantity delivered to the combustion chamber increases continuously with the rightward movement of the wipers and decreases continuously with the leftward movement of the wipers.

The movement of the wiper terminals 90 is made to correspond to the detected engine operating parameters with the electromechanical transducer 84. The control circuit 78 thus operates to provide stepwise operation of the injectors as well as continuous operation of each injector.

When all the injectors are operating at their full capacities, a variation of the potential at the accelerator electrodes of all the injectors will produces a simultaneous variation of fuel quantity ejected from each injector. It is thus possible to provide a coarse fuel quantity control by means of the control circuit 36 in response to a detected throttle position and then a fine control is effected by controlling the individual injectors in response to detected various engine operating parameters such as engine temperature, intake vacuum and engine RPM.

The foregoing description shows only exemplary embodiments of the invention. Each of the afore-mentioned voltage control circuits may also be constructed of all electronic circuit elements. The voltage applied to the control electrodes may be in digital form using a pulse width modulator which functions to generate an output pulse of which the duration is proportional to the input signal.

What is claimed is:

1. A method for operating a fuel injector mounted in an air intake passage of an internal combustion engine, the fuel injector comprising a plurality of threadlike tubes each connected at one end to a source of fuel, a control electrode adjacent to other ends of said threadlike tubes and an accelerator electrode spaced from said control electrode remote from said other ends of said tubes, said method comprising:

applying a high potential to said accelerator electrode with respect to fuel charging electrode means so that fuel is electrostatically charged with respect to said accelerator electrode and an electrostatic field is established between said accelerator electrode and a mass of fuel in said other ends of said tubes thereby causing the fuel in said tubes to be ejected therefrom to said accelerator electrode;

applying a lower potential to said control electrode with respect to said accelerator electrode to modify said electrostatic field for controlling the amount of fuel ejected from said tubes;

detecting an operating parameter of said engine; and modulating said lower potential in accordance with the detected engine operating parameter.

2. A method as claimed in claim 1, further comprising the steps of detecting another engine operating parameter and modulating said higher potential in response to said detected another engine operating parameter.

3. A method as claimed in claim 2, wherein said modulating the higher potential includes modulating said higher potential in discrete levels of which the duration of each level is variable in response to the detected another engine operating parameter.

4. A method as claimed in claim 1, wherein said modulating the lower potential includes varying the polarity of said lower potential in response to the detected engine operating parameter.

* * * * *